United States Patent [19]

Kruger

[11] 4,194,469

[45] Mar. 25, 1980

[54] COMPACT V-TYPE INTERNAL COMBUSTION ENGINE

[75] Inventor: Hermann Krüger, Wolfsburg, Fed. Rep. of Germany

[73] Assignee: Volkswagenwerk Aktiengesellschaft, Wolfsburg, Fed. Rep. of Germany

[21] Appl. No.: 931,206

[22] Filed: Aug. 4, 1978

[30] Foreign Application Priority Data

Jul. 9, 1977 [DE] Fed. Rep. of Germany ..... 2740173

[51] Int. Cl.[2] ..... F02B 75/22

[52] U.S. Cl. ..... 123/54 R; 123/55 R; 123/55 US

[58] Field of Search ..... 123/52 R, 52 MC, 54 R, 123/55 R, 55 VF, 55 VS, 55 VE, 55 V, 59 R, 59 A, 59 B, 193 C, 193 CH

[56] References Cited

U.S. PATENT DOCUMENTS

| | | | |
|---|---|---|---|
| 1,429,877 | 9/1922 | Heuser | 123/52 P |
| 1,531,430 | 3/1925 | Wrentmore | 123/52 R |
| 2,941,521 | 6/1960 | Rarey et al. | 123/55 VE |
| 2,944,536 | 7/1960 | Payne | 123/55 R |
| 3,034,491 | 5/1962 | Balmer | 123/55 VS |

FOREIGN PATENT DOCUMENTS

| | | | |
|---|---|---|---|
| 387939 | 7/1908 | France | 123/54 R |

*Primary Examiner*—Charles J. Myhre
*Assistant Examiner*—Craig R. Feinberg
*Attorney, Agent, or Firm*—Brumbaugh, Graves, Donohue & Raymond

[57] ABSTRACT

A V-type internal combustion engine including a plurality of pistons and cylinders acting on a crankshaft and having a common cylinder head. The pistons and cylinders are arranged in two banks, the cylinders of the first bank arranged interstitially with the cylinders of the second bank in a longitudinal direction. Each of the cylinders and/or pistons is provided with recesses facing the adjacent cylinder or cylinders which extends partially along the cylinder and/or piston from the crankshaft-side thereof.

5 Claims, 3 Drawing Figures

COMPACT V-TYPE INTERNAL COMBUSTION ENGINE

BACKGROUND OF THE INVENTION

The invention is a compact V-type internal combustion engine. V-type internal combustion engines including a plurality of pistons and cylinders acting on a crankshaft and having a common cylinder head are known and are described, for example in "Automobiltechnisches Handbuch"/"Handbook of Automotive Engineering", 18th Edition (1953), 2d Vol., pp. 48 and 94. If the engine is designed such that the cylinders are formed in two banks, and the banks are arranged so that the angle between the longitudinal axes of the cylinders of the first bank relative to the longitudinal axes of the cylinders of the second bank is small, for example, 10°–20°, it is possible to create a compact or short engine, which also has a comparatively small width.

A further advantage of this type of construction results from the close lateral spacing between cylinder valves of the two banks of cylinders. Not only will one camshaft suffice to actuate the valves associated with both banks of cylinders, but also a common cylinder head may be provided for all the cylinders.

SUMMARY OF THE INVENTION

In accordance with this invention, an engine of the aforementioned type is further improved to result in a reduction of the overall length. This is accomplished by providing a V-type internal combustion engine, having two banks of pistons and cylinders, the cylinders of the first bank arranged interstitially with the cylinders of the second bank in a longitudinal direction, wherein each cylinder will have one or more recesses therein, one recess for each adjacent cylinder, and each recess facing an adjacent cylinder and extending partially along the cylinder from the crankshaft-side thereof.

Although it is known in the prior art to provide pistons with recesses in the crankshaft-side edges, such recesses are normally provided in order to reduce weight, and such recesses face one another in the direction of the longitudinal axis of the crankshaft. In the present invention, on the other hand, the pistons and/or cylinders are provided with recesses arranged differently, namely in the area facing the adjacent cylinder of another cylinder bank. Accordingly, the pertinent recesses on any given piston or cylinder will not, as in the prior art, be diametrically opposed, but rather will follow the zig-zag pattern of the cylinder arrangement.

As a result of the recesses arranged in this manner, it is possible to have the various cylinders succeed each other in an interstitial fashion along the longitudinal direction of the engine at a closer spacing than was heretofore possible. This is due to the fact that the minimal separation between cylinders is determined by the lower end regions of the cylinders and/or pistons, that is, the end facing the crankshaft, since in regions other than the lower end, or bottom dead center of the piston, the cylinder and piston paths in each bank will diverge from each other.

The engine arrangement may also be simplified, thus further reducing the space requirement, by arranging the valves associated with both banks of cylinders linearly. The arrangement of all the valves along the straight line facilitates the use of a cup tappet valve control, itself known.

As described above, the features provided in accordance with the present invention facilitate a very compact construction of the engine, particularly in the longitudinal direction. At the same time, however, it is still possible to have all the inlet ports and all the outlet ports of the cylinders arranged to extend outwardly on the same side of the engine, which is preferred as a rule. This may be accomplished conveniently by having the ports arranged to extend relative to the longitudinal axis of the crankshaft at an angle different from 90°.

The invention is applicable whether or not one or both cylinder banks form an angle with the center longitudinal plane of the engine. In order to reduce the overlapping of successive cylinders in the longitudinal direction of the engine, and thereby achieve an even more compact construction, the cylinders may be arranged so that the longitudinal axes of the cylinders associated with each of the banks lie in a common plane, and one or both of the planes extend to the side of the longitudinal axis of the rotation of the crankshaft.

BRIEF DESCRIPTION OF THE DRAWINGS

For a better understanding of the present invention, references made to the accompanying drawings, in which.

DETAILED DESCRIPTION OF THE PREFERRED EMBODIMENTS

Figure 1:
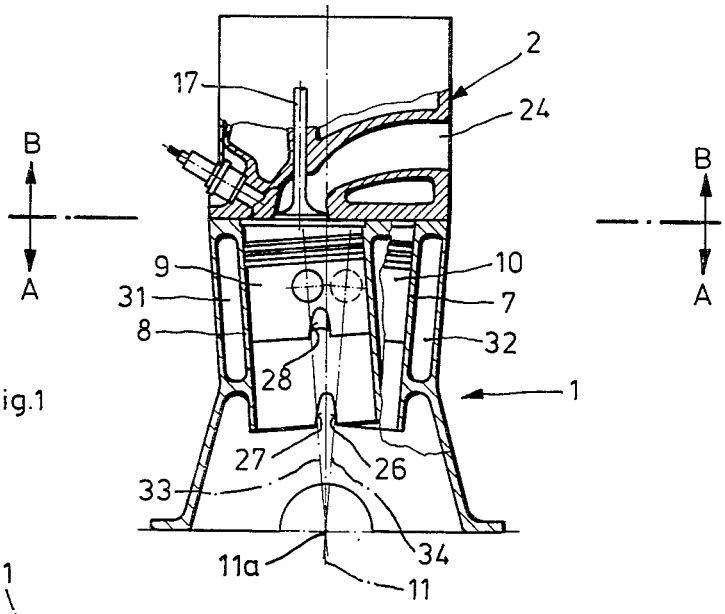
FIG. 1 is a longitudinal sectional view of a compact V-type internal combustion engine according to the invention.
Figure 2:
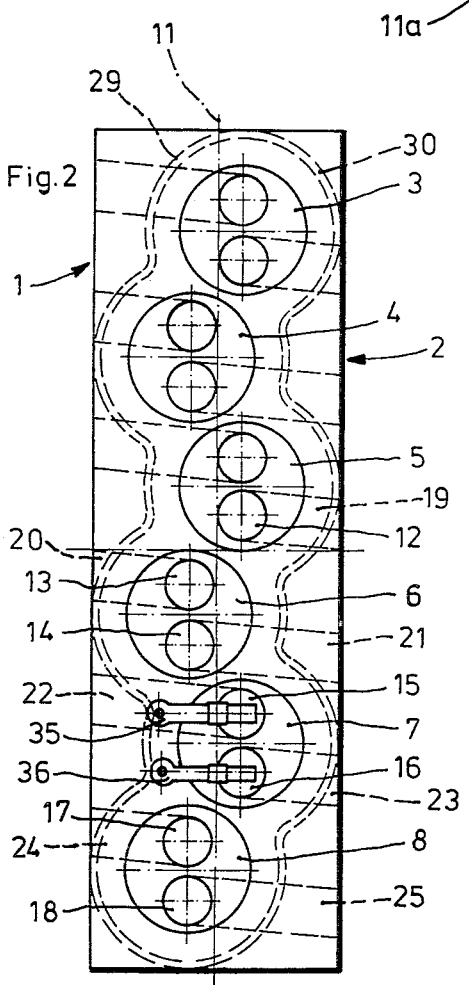
FIG. 2 is a sectional view, the upper portion thereof taken as indicated by the arrows A—A of FIG. 1, and the lower portion thereof taken as indicated by the arrows B—B of FIG. 1.

Referring to the drawings, a V-type internal combustion engine includes a cylinder head 2 fixed on the engine block 1. In the examples shown, the engine block comprises 6-cylinders, designated 3–8 in FIG. 2. Cylinders 7 and 8 also appear in FIG. 1. Associated with each cylinder is a piston, for example 9 and 10 in FIG. 1 associated with cylinders 7 and 8, which are connected in the customary manner to connecting rods and a crankshaft whose longitudinal axis is indicated at 11*a*. As shown in FIG. 1, the longitudinal axis 11*a* of the crankshaft lies in the plane of symmetry 11 between the two banks of cylinders, that is the plane equidistant from the longitudinal axes 33 and 34 of the cylinders of the first and second bank of cylinders, respectively. Intake and exhaust valves, designated 12 to 18 in FIG. 2, are associated with each cylinder in the customary manner. The valves are associated with inlet and exhaust ports 19 to 25, which, as are shown in the bottom portion of FIG. 2, extend in plan view at a slant, that is, at other than a 90° angle, relative to the longitudinal axis of 11 of the crankshaft, thus bypassing in a simple manner the adjacent cylinders and their valve arrangements.

The cylinders, as well as the pistons are provided with recesses 26, 27, and 28 extending partially along the cylinders and pistons from the crankshaft side, or bottom, thereof, as shown in FIG. 1 for cylinders 7 and 8, and piston 9. The recesses in each case are arranged so that they face the adjacent cylinder and thus piston, so that excepting the two end cylinders 3 and 8, and their corresponding pistons, each cylinder and piston will have two such recesses, one facing each adjacent cylinder. The end pistons 3 and 8, and their corresponding pistons, since they each have only one cylinder adjacent them, 4 and 7, respectively, will have only one such recess. These recesses do not affect the guiding of the piston within the cylinder in that they are only local, and sufficient bearing surface remains so that performance will not be affected. These recesses, however, do permit neighboring cylinders to be placed closer to one another than would be otherwise possible, and thereby result in a more compact engine.

Because of this compact construction, care must be taken to provide sufficient cooling. It is advisable, as indicated in the upper portion of FIG. 2, that the outer walls 29 and 30 of the cylinder block follow at least approximately the cylinder contour, at least along the longitudinal sides of the engine. Preferably, these walls may also be provided with cooling fins. Coolant ducts 31 and 32, may also be provided.

The small angle between the longitudinal axes 33 and 34 of the cylinders associated with each of the cylinder banks, as a rule not greater than 15°, makes it possible to use a single camshaft for actuation of the valves of all the cylinders. The axis of rotation of the camshaft will be parallel to the longitudinal axis 11*a* of the crankshaft, and lie in the plane of symmetry 11 between the two banks of cylinders, as indicated in FIG. 2. Transmission of the motion is obtained by drag levers, two of which 35 and 36, associated with valves 15 and 16, are illustrated in FIG. 2.

Figure 3:
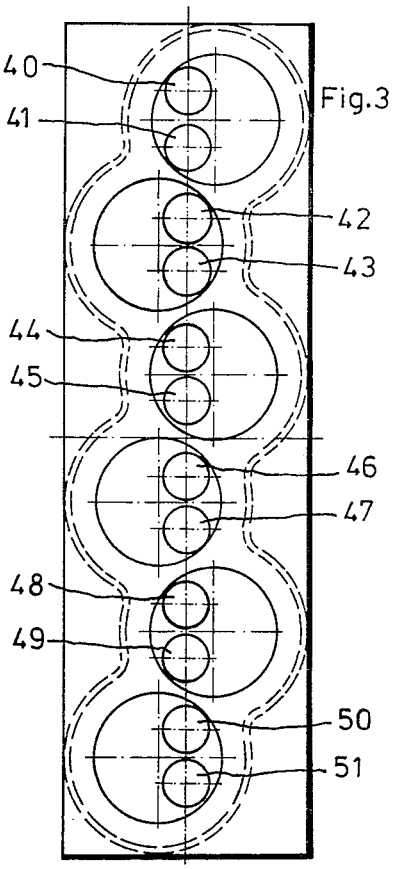
FIG. 3 represents a sectional view taken as indicated by the arrows B—B of FIG. 1, of another embodiment of the invention.

Drag levers of this kind may be dispensed with in accordance with the embodiment shown in FIG. 3. All of the valves 40 to 51 of this construction are arranged along a common straight line which is parallel to the axis of the crankshaft and in the plane of symmetry between the two banks of cylinders. In this case, cup tappets (not shown) of a known type may be employed.

In the embodiment shown in FIG. 1, the longitudinal axes of the cylinders of each bank of cylinders will lie in a common plane, and both planes intersect the longitudinal axis 11*a* of the crankshaft. However, the plane containing the longitudinal axis of all the cylinders associated with either of the two banks of cylinders, or both, may extend so as not to intersect the longitudinal axis 11*a* of the crankshaft. In such an arrangement, the adjacent cylinders and pistons will be somewhat separated precisely in the critical zone of their bottom edges and bottom dead centers, respectively. This will allow for an even more compact construction, since it will reduce the overlapping of successive cylinders in the longitudinal direction of the engine.

Although the invention has been described in accordance with two preferred embodiments as set out in the aforegoing detailed description, the invention may be embodied in other forms while still containing the inventive principles disclosed therein. Thus, variations and modifications of the devices disclosed will be apparent to those skilled in the art, and all such variations and modifications are intended to be within the scope of the invention as contained in the following claims.

I claim:

1. In a V-type internal combustion engine including a plurality of pistons and cylinders having a common cylinder head and a plurality of valves associated with the pistons and cylinders, said pistons acting on a crankshaft and said pistons and cylinders arranged in two banks, the cylinders of the first bank arranged interstitially with the cylinders of the second bank in a longitudinal direction, the improvement wherein each cylinder has at least one recess therein, one said recess for each adjacent cylinder, each said recess facing an adjacent cylinder and extending partially along said cylinder from the crankshaft-side thereof, and wherein said valves are arranged along a straight line.

2. In a V-type internal combustion engine including a plurality of pistons and cylinders having a common cylinder head and a plurality of valves associated with the pistons and cylinders, said pistons acting on a crankshaft and said pistons and cylinders arranged in two banks, the cylinders of the first bank arranged interstitially with the cylinders of the second bank in a longitudinal direction, the improvement wherein each piston has at least one recess therein, one said recess for each adjacent cylinder, each said recess facing an adjacent cylinder and extending partially along said piston from the crankshaft-side thereof, and wherein said valves are arranged along a straight line.

3. A V-type internal combustion engine according to claim 1, wherein each piston has at least one recess therein, one said recess for each adjacent cylinder, each said recess facing an adjacent cylinder and extending partially along said piston from the crankshaft-side thereof.

4. A V-type internal combustion engine including a plurality of inlet and outlet ports in the cylinder head associated with said valves, according to claim 1, 2, or 3, wherein said inlet and outlet ports are disposed relative to the longitudinal axis of rotation of the crankshaft at other than 90°.

5. A V-type internal combustion engine according to claim 1, 2, or 3, wherein the longitudinal axes of the cylinders associated with each said bank of cylinders lie in a common plane, and wherein at least one of said planes does not intersect the longitudinal axis of rotation of the crankshaft.

* * * * *

UNITED STATES PATENT AND TRADEMARK OFFICE

CERTIFICATE OF CORRECTION

PATENT NO. : 4,194,469

DATED : March 25, 1980

INVENTOR(S) : Kruger, Hermann

It is certified that error appears in the above-identified patent and that said Letters Patent are hereby corrected as shown below:

First Page, Item [30], "July 9, 1977", should read --Sept. 7, 1977.--

Signed and Sealed this

*Twenty-sixth* Day of *August 1980*

[SEAL]

*Attest:*

SIDNEY A. DIAMOND

*Attesting Officer*

*Commissioner of Patents and Trademarks*